US005481829A

United States Patent [19]

Waytashek

[11] Patent Number: 5,481,829

[45] Date of Patent: Jan. 9, 1996

[54] DOOR AND WINDOW CONSTRUCTION AND MOUNTING ASSEMBLY FOR IMPROVED SECURITY, VENTILATION AND AESTHETICS

[76] Inventor: Dave G. Waytashek, 1702 Rio Vista La., Santa Maria, Calif. 93454

[21] Appl. No.: 276,837

[22] Filed: Jul. 18, 1994

[51] Int. Cl.[6] ..... E06B 7/28

[52] U.S. Cl. ..... 49/171; 49/64; 49/82.1

[58] Field of Search ..... 49/171, 169, 168, 49/163, 64, 82.1, 501

[56] References Cited

U.S. PATENT DOCUMENTS

| | | | |
|---|---|---|---|
| 2,955,815 | 10/1960 | Muhr | 49/82.1 X |
| 3,110,937 | 11/1963 | Naslund | 49/82.1 X |
| 4,912,877 | 4/1990 | Strydom | 49/171 |
| 4,967,509 | 11/1990 | Storey et al. | 49/64 X |
| 5,267,413 | 12/1993 | Hubert et al. | 49/82.1 X |

*Primary Examiner*—Philip C. Kannan

[57] ABSTRACT

A closure construction and mounting assembly comprising: a steel frame in a rectangular configuration having horizontal parallel upper and lower extents and vertical parallel interior and exterior side extents with a central aperture extending therethrough; a panel positioned within the central aperture, the panel having a gridwork of horizontally disposed steel members and vertically disposed steel members in a gridlock configuration to form rectangular apertures extending therethrough, with the spacing between the apertures sized such as to preclude the passage of a person therethrough; coverings secured to the panel peripherally and in contact with the steel members to cover the apertures; and adjustment mechanisms for moving the panel between a locked and unlocked orientation.

1 Claim, 5 Drawing Sheets

DOOR AND WINDOW CONSTRUCTION AND MOUNTING ASSEMBLY FOR IMPROVED SECURITY, VENTILATION AND AESTHETICS

BACKGROUND OF THE INVENTION

1. Field of the Invention

The present invention relates to a door and window construction and mounting assembly for improved security, ventilation and aesthetics and more particularly pertains to improving the positive security, refreshing ventilation and the aesthetic enhancement of any decor through a door assembly and/or window assembly and associated mounting capabilities.

2. Description of the Prior Art

The use of doors and windows and their securement to an opening is known in the prior art. More specifically, doors and windows and their securement to an opening heretofore devised and utilized for the purpose of securing doors and windows to openings include a wide variety of techniques which are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,155,956 to Norment a metal window construction.

U.S. Pat. No. 4,977,722 to Taylor discloses a frame system.

U.S. Pat. No. 4,295,299 to Nelson discloses a steel-clad wood door frame.

U.S. Pat. No. 3,599,860 to Newell discloses an entrance door and method of construction.

In this respect, the door and window constructions and mounting assemblies for improved security, ventilation and aesthetics according to the present invention substantially depart from the conventional concepts and designs of the prior art, and in doing so provide apparatuses primarily developed for the purpose of improving the positive security, refreshing ventilation and the aesthetic enhancement of any decor through a door assembly and/or window assembly and associated mounting capabilities.

Therefore, it can be appreciated that there exists a continuing need for new and improved door and window constructions and mounting assemblies for improved security, ventilation and aesthetics which can be used for improving the positive security, refreshing ventilation and the aesthetic enhancement of any decor through a door assembly and/or window assembly and associated mounting capabilities. In this regard, the present invention substantially fulfills this need.

SUMMARY OF THE INVENTION

In view of the foregoing disadvantages inherent in the known types of doors and windows and their securement mechanisms to an opening now present in the prior art, the present invention provides an improved door and window construction and mounting assembly for improved security, ventilation and aesthetics. As such, the general purpose of the present invention, which will be described subsequently in greater detail, is to provide a new and improved door and window construction and mounting assembly for improved security, ventilation and aesthetics and method which has all the advantages of the prior art and none of the disadvantages.

To attain this, the present invention essentially comprises a new and improved door construction and mounting assembly for improved security, ventilation and aesthetics comprising, in combination: a steel frame in a rectangular configuration having short horizontal parallel upper and lower extents and long vertical parallel interior and exterior side extents with at least one central opening extending therethrough, the interior extent having hinges for the pivotal securement to a casement and the exterior extent having a handle assembly for locking and unlocking the door; a panel positioned within the central opening, the panel having a gridwork of horizontally disposed steel members and vertically disposed steel members in a gridlock configuration to form rectangular apertures extending therethrough, the vertical steel members having axially aligned bores therethrough, with the spacing between the apertures sized such as to preclude the passage of a person there-through, the panel having a plurality of inserts located within the apertures with vertical disposed hinges coupling the inserts and the vertical steel members for allowing the selective covering and uncovering of the apertures; and adjustment mechanisms for moving the inserts between closed positions and open positions, the adjustment mechanisms including a horizontally disposed rotary drive rod with exterior threads on the surface thereof located through the aligned bores, cylindrical collars with interior threads located at spaced points along the length of the drive rod at locations adjacent to the inserts, coupling links pivotally secured between the cylindrical collars and the ends of the inserts remote from the hinges and a worm gear with a handle located on the inside of the door whereby rotation of the handle and the worm gear will rotate the drive rod to move the cylindrical collars in unison to pivot the inserts between open positions and closed positions at the discretion of an operator.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door and window construction and mounting assembly for improved security, ventilation and aesthetics which has all the advantages of the prior art doors and windows and their securement mechanisms to an opening and none of the disadvantages.

It is another object of the present invention to provide a new and improved door and window construction and mounting assembly for improved security, ventilation and aesthetics which may be easily and efficiently manufactured and marketed.

It is a further object of the present invention to provide a new and improved door and window construction and mounting assembly for improved security, ventilation and aesthetics which are of durable and reliable constructions.

An even further object of the present invention is to provide a new and improved door and window construction and mounting assembly for improved security, ventilation and aesthetics which is susceptible of a low cost of manufacture with regard to both materials and labor, and which accordingly is then susceptible of low prices of sale to the consuming public, thereby making such door and window construction and mounting assembly for improved security, ventilation and aesthetics economically available to the buying public.

Still yet another object of the present invention is to provide a new and improved door and window construction and mounting assembly for improved security, ventilation and aesthetics which provides in the apparatuses and methods of the prior art some of the advantages thereof, while simultaneously overcoming some of the disadvantages normally associated therewith.

Still another object of the present invention is to improve the positive security, refresh ventilation and the aesthetic enhancement of any decor through a door assembly and/or window assembly and associated mounting capabilities.

Lastly, it is an object of the present invention to provide a new and improved closure construction and mounting assembly comprising: a steel frame in a rectangular configuration having horizontal parallel upper and lower extents and vertical parallel interior and exterior side extents with a central aperture extending therethrough;a panel positioned within the central aperture, the panel having a gridwork of horizontally disposed steel members and vertically disposed steel members in a gridlock configuration to form rectangular apertures extending therethrough, with the spacing between the apertures sized such as to preclude the passage of a person therethrough; coverings secured to the panel peripherally and in contact with the steel members to cover the apertures; and adjustment mechanisms for moving the panel between a locked and unlocked orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
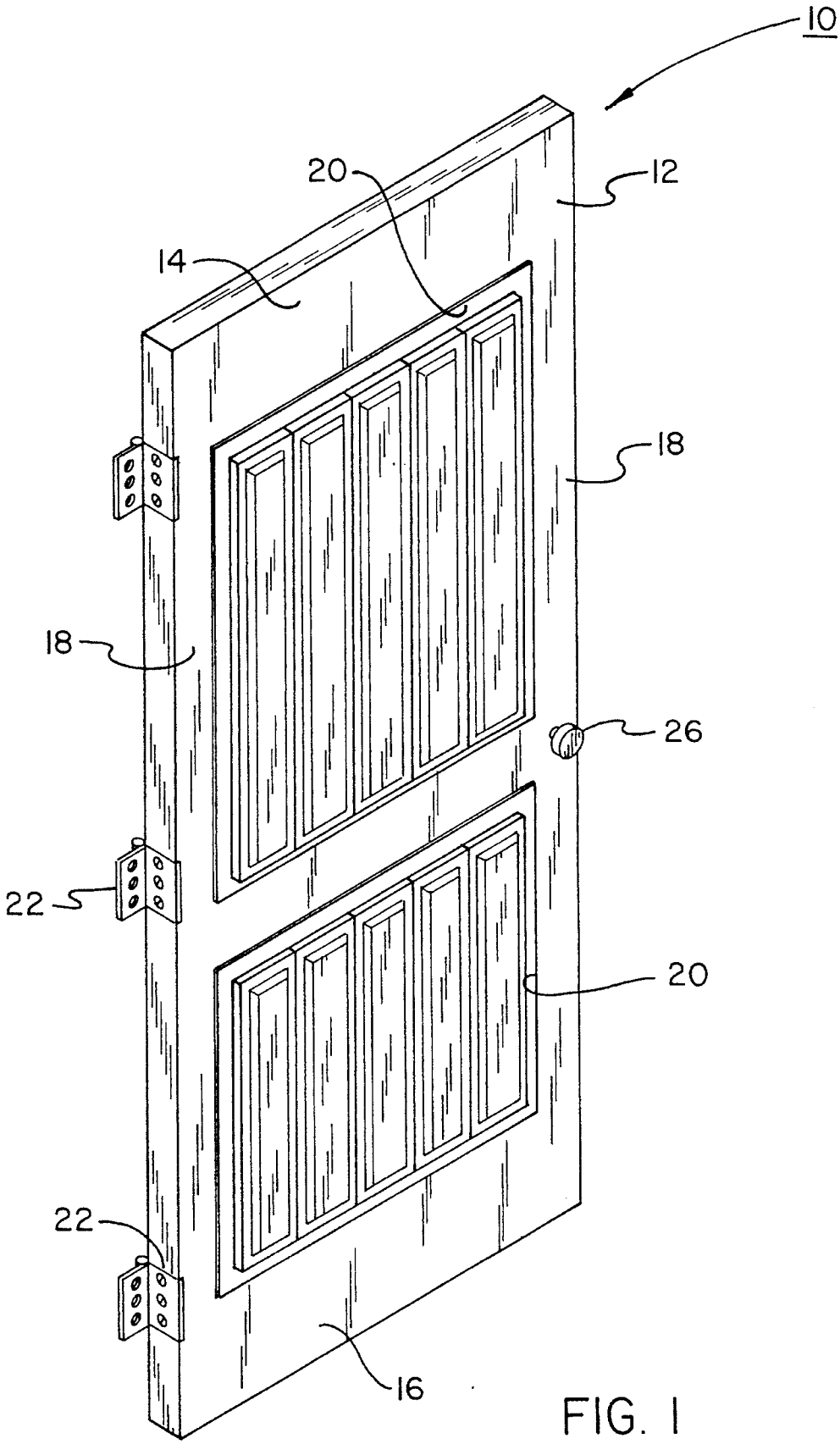
FIG. 1 is a perspective illustration of the preferred embodiment of the new and improved door construction and mounting assembly for improved security, ventilation and aesthetics.
Figure 2:
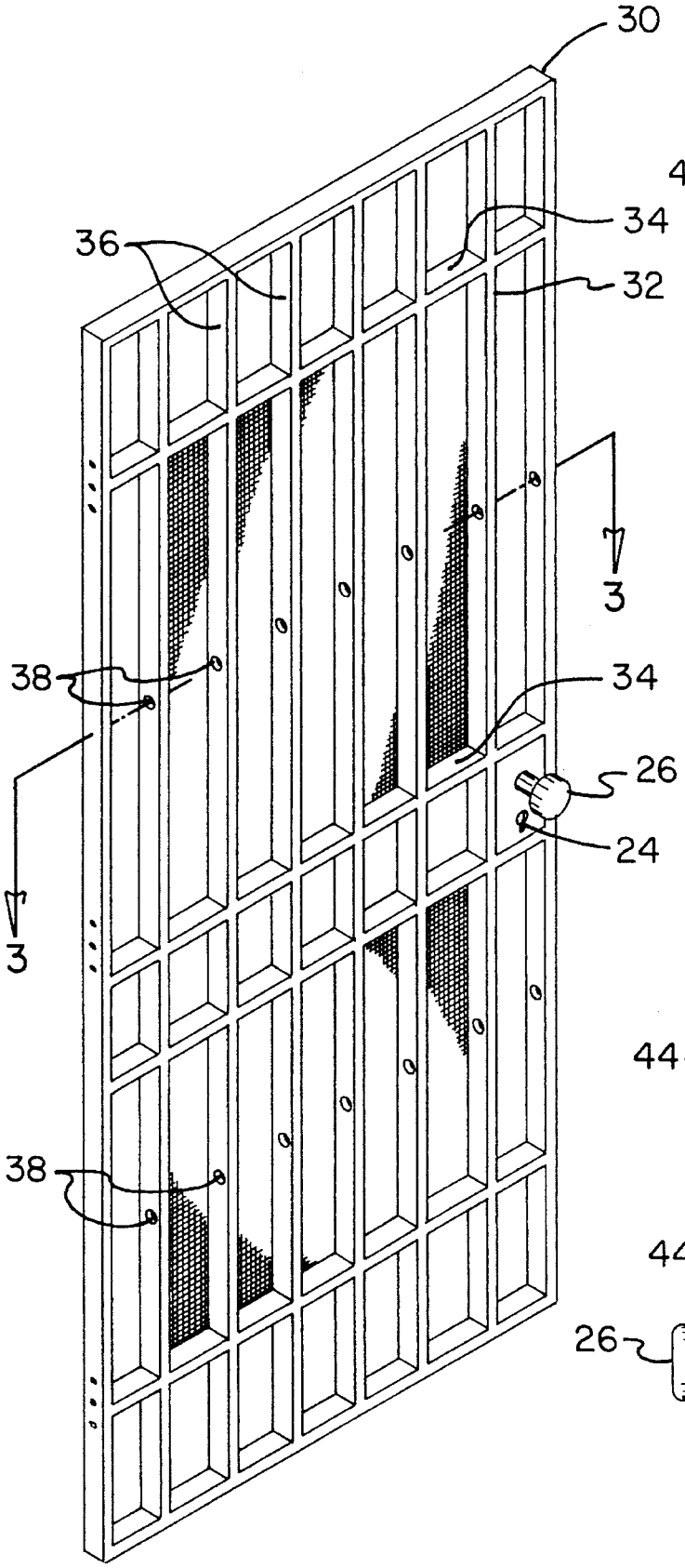
FIG. 2 is a perspective illustration of the panel shown in FIG. 1.

With reference now to the drawings, and in particular to FIG. 1 thereof, the preferred embodiment of the new and improved door and window construction and mounting assembly for improved security, ventilation and aesthetics embodying the principles and concepts of the present invention and generally designated by the reference numeral 10 will be described.

The invention, the new and improved door and window construction and mounting assembly for improved security, ventilation and aesthetics is comprised of a plurality of components. In their broadest context, such components include a steel frame, a panel, coverings secured to the panel and adjustment mechanisms. Such components are specifically configured and correlated with respect to each other so as to attain the desired objective.

Figure 4:
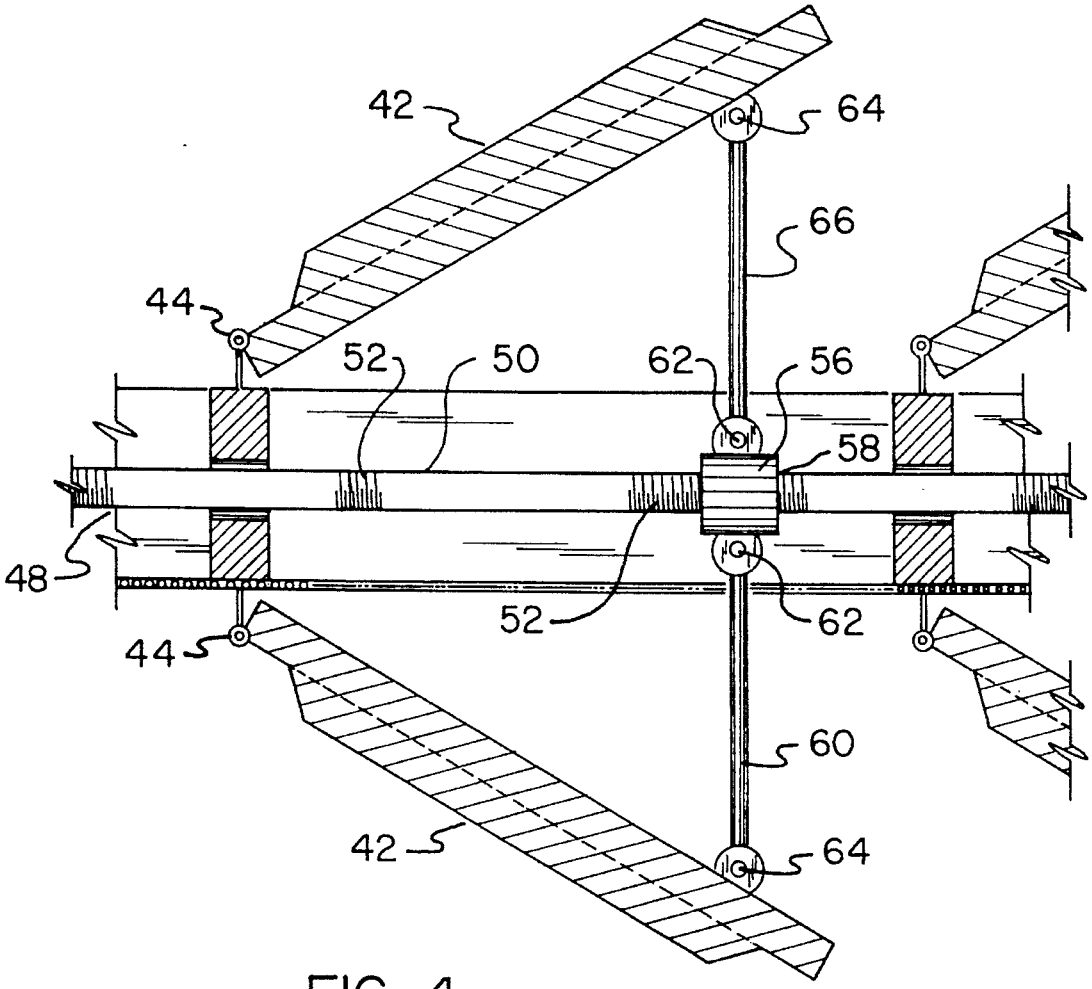
FIG. 4 is an enlarged cross-sectional view of a portion of the hinges shown in FIG. 2.
Figure 5:
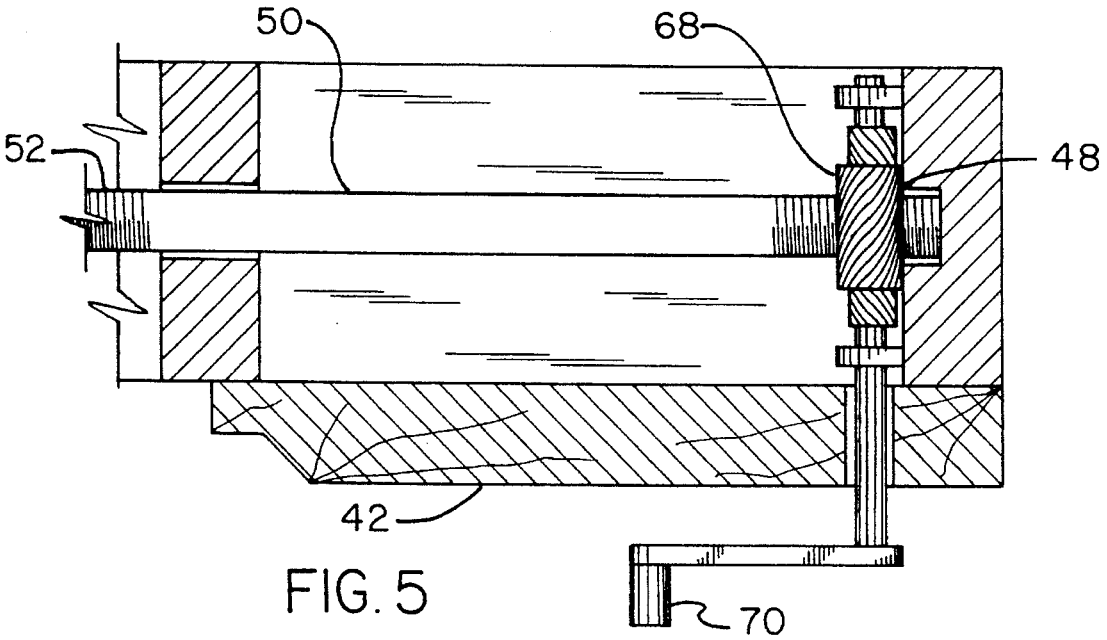
FIG. 5 is an enlarged cross-sectional view of the control mechanisms for the apparatus of the prior Figures.
Figure 6:
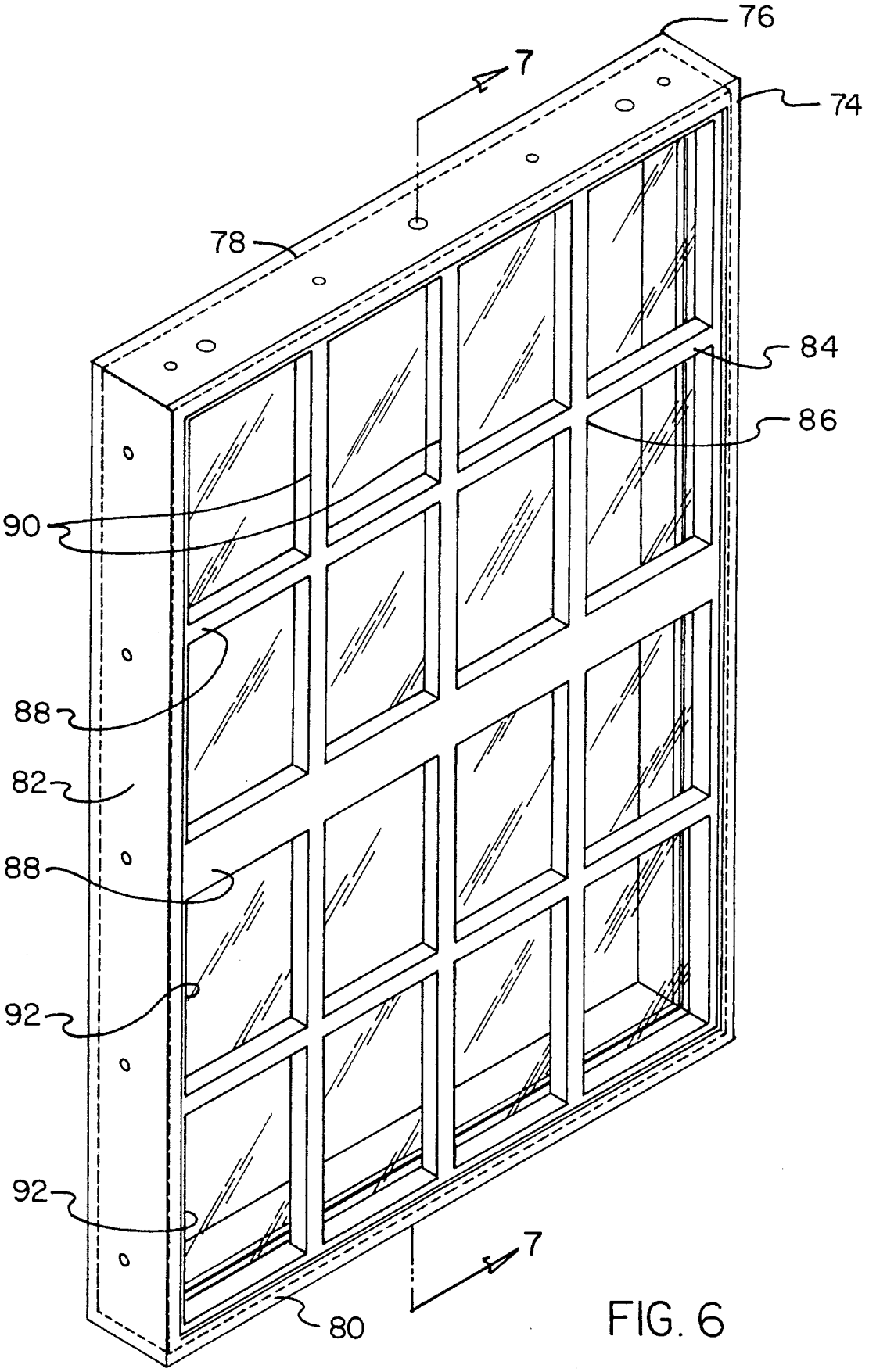
FIG. 6 is a perspective illustration of an alternate emodiment of the window construction.
Figure 7:
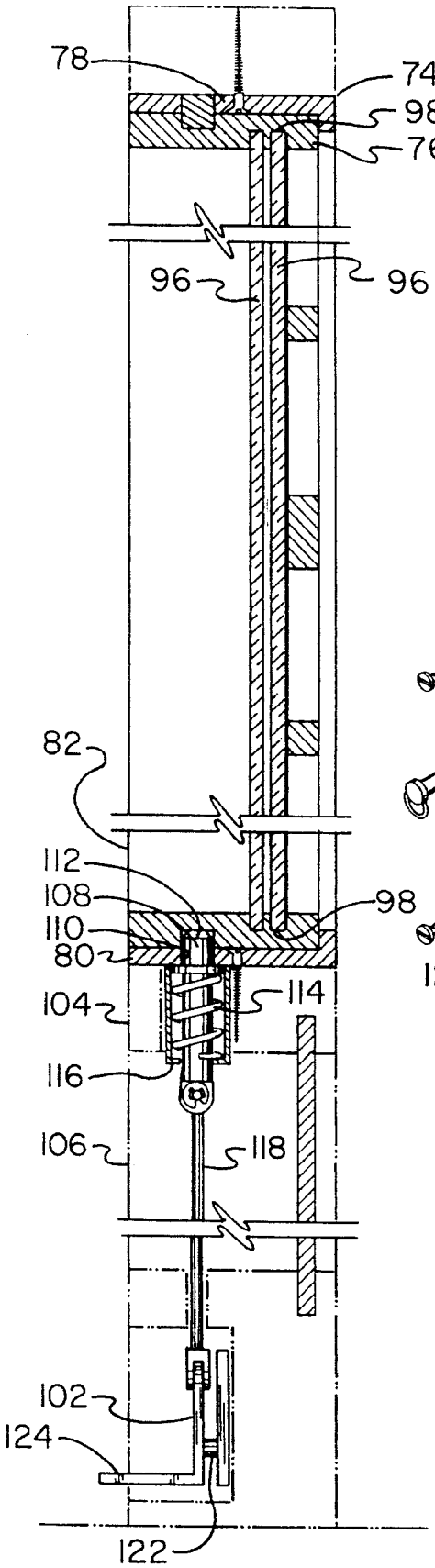
FIG. 7 is a cross-sectional view taken along line 7–7 of FIG. 6.
Figure 8:
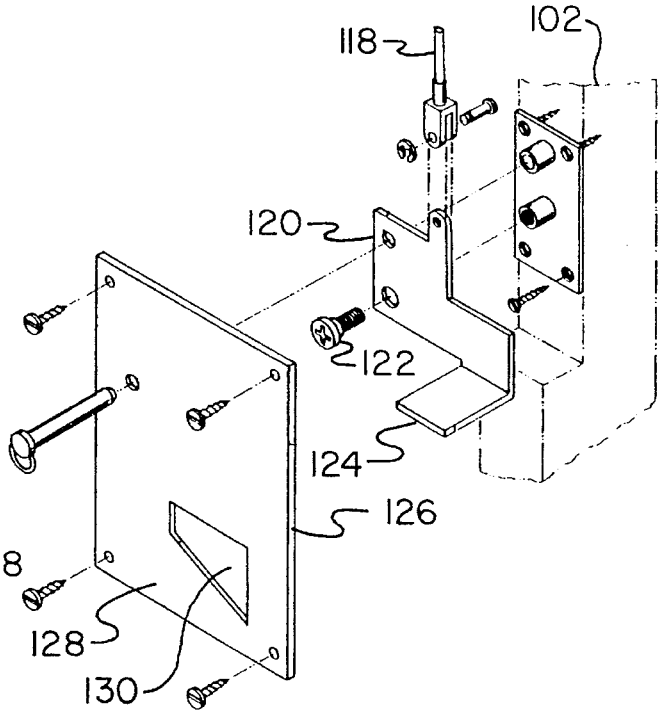
FIG. 8 is an exploded perspective view partially in section of the control mechanisms of FIG. 7.

More specifically, the system 10 is, in the embodiment shown in FIGS. 1 through 5, related to a door. The embodiment of FIGS. 6 through 8 is directed to a window. The door and windows are types of closures which may be used in the practicing of the present invention.

With regard to the first embodiment, the system 10 includes a steel frame 12 in a rectangular configuration. Such frame has short horizontal parallel upper and lower extents 14 and 16. It also includes long vertical parallel interior and exterior side extents 18. At least one central opening 20, but preferably two, extend therethrough. The interior extent has hinges 22 for the pivotal securement of the frame to a conventional casement, not shown. The exterior extent opposite from the hinges has a handle assembly 24 with a knob 26 for locking and unlocking the door, again in a conventional manner.

Next provided is a panel 30. The panel is positioned within the central opening, or openings, of the frame. The panel has a gridwork 32 of horizontally disposed steel members 34 and vertically disposed steel members 36 in a gridlock configuration. Such steel members thus form rectangular apertures extending therethrough. The vertical steel members have axially aligned bores 38 extending therethrough. The spacing between the apertures is such that they are sized to preclude the passage of a person therethrough. This construction is for added security of the system against unauthorized entry to the house or building in which it is located. In addition, the steel members as well as the steel frame may be provided with an aesthetically pleasing finish to enhance the appearance of the system.

The panels also have a plurality of inserts 42. Such inserts are located within the apertures of the panel. The inserts are rectangular in shape to correspond to the shape of the apertures being covered. The inserts also have vertically disposed hinges 44 coupling the inserts along one edge to the vertical steel members thereadjacent. This is for allowing the selective covering and uncovering of the apertures for ventilation as may be desired.

Figure 3:
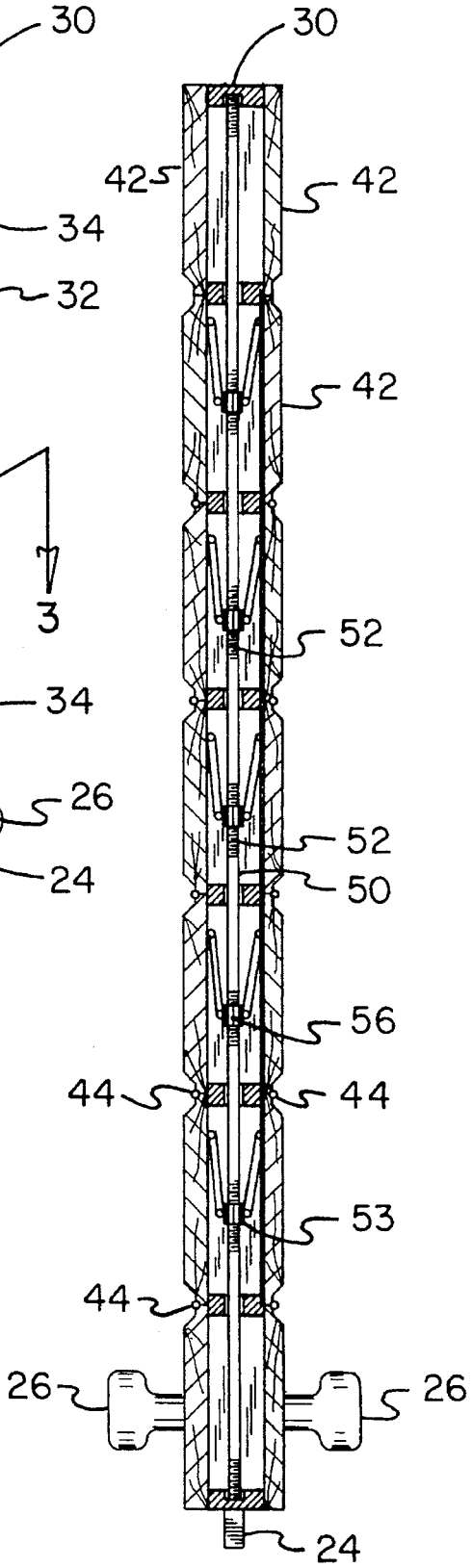
FIG. 3 is a cross-sectional view taken along line 3–3 of FIG. 2.

The last component of the system 10 is the adjustment mechanisms 48. The adjustment mechanisms are for moving the inserts between closed positions as shown in FIGS. 1, 3 and 5, and open positions as shown in FIG. 4. The adjustment mechanisms included a horizontally disposed rotary drive rod 50. Such drive rod has exterior threads 52 on its surface. The drive rod is located through the aligned bores of the vertical members for rotation therewithin.

In association therewith, cylindrical collars 56 are provided with interior threads 58. The collars are located at space points along the length of the drive rod at locations adjacent to the inserts. Coupling links 60, two for each collar, are pivotally secured at their interior ends to the cylindrical collars through pivot pins 62. The ends of the links remote from the collars are pivotally coupled to the inserts through pivot pins 64. Such coupling to the inserts is at locations remote from the hinges.

Movement of the adjustment mechanisms is provided through a worm gear 68 and an associated handle 70. The handle is located on the inside of the door for security purposes. Rotation of the handle rotates the worm gear. Such rotation of the worm gear is at right angles to the drive rod to which it is coupled through the screw threads. Location of the worm gear will thus rotate the drive rod in one direction or another to move the cylindrical collars in unison. This functions to pivot the inserts through the links between open positions and closed positions at the discretion of the operator.

The embodiment shown in FIGS. 6, 7 and 8 is similar to that of the primary embodiment but the closure is a window 74 rather than the door as shown in the prior Figures. Such second embodiment has a steel frame 76 in a rectangular configuration with horizontal parallel upper and lower extents 78 and 80 and vertical parallel side extents 82. A central aperture 84 extends through the frame.

Next provided is a panel 84. The panel is positioned within the central aperture. The panel also has a gridwork 86 of horizontally disposed steel members 88 and vertically disposed steel members 90 in a gridlock configuration. The members thus form rectangular apertures 92 extending therethrough. The spacing between the apertures are sized such as to preclude the passage of a person therethrough.

Next provided is the glass 96 preferably formed as a dual-paned construction. The glass is secured to the panel at its periphery 98. It is in contact at its periphery to the steel member and at spaced lines vertically and horizontally on its front surface. The glass thus covers the apertures.

The last component of the system of the second embodiment is the pedal release mechanisms 102. Such mechanisms are secured within the lower extent 104 of the frame and the lower extent 106 of the panel. Such mechanisms include a vertically reciprocable locking pin 108. Such pin is movable from an upper locked position as shown in FIG. 7 to a lower unlocked position. In the locked position, the aperture is located within an aperture 110 of the frame and an aperture 112 of the panel. A spring 114 is secured within an adjacent housing 116 to urge the locking pin upwardly to the locked position. Cables 118 extend downwardly from the lower end of the locking pin. An associated cam member 120 is coupled to the lower end of the cable. The cam has a pivot pin 122 and a pedal 124. The arrangement is such whereby depression of the pedal will rotate the cam to pull the cable and retract the locking pin from its locking position. This allows removal of the panel from the frame when desired at the discretion of the operator. The pedal is located on the inside of the casing to preclude access by an unintended source. In addition, a security panel 126 of steel or other rigid material is on the side of the adjustment mechanisms remote from the pedal to preclude unauthorized access to the pedal and other release mechanisms. Lastly, the release mechanism includes a trim plate 128 with an aperture 130 for the passage of the pedal therethrough and to cover the cam and the associated components.

It should be realized that the utility of the window may be enhanced by having the glass arranged on a supplemental support. This would allow the vertical sliding of the glass with respect to the frame and/or insert for ventilation purposes independent of removing the insert from the frame. Other variations for attaining ventilation are also available.

The present invention is designed to yield three distinct advantages: positive security, refreshing ventilation of the area and aesthetic enhancement of any decor. Both apertures feature a case hardened steel frame which is permanently affixed to the surrounding wooden casing using screws through pre-drilled holes in the steel frame. The window has a central panel which is either hinge mounted or a sliding panel, and is actuated by a cranking handle located well below the bottom of the window. A release latch is affixed to the bottom of this handle.

This panel is made in the form of a meshed grid made of steel but the mounting frame simulated the grain of an attractive hardwood. The spacing between each of the grid members is approximately five inches, too small for the insertion of a human arm. The door is made in a similar fashion, except two panels are incorporated, one in the upper section and one in the lower. The pattern used across these panels is one of vertically oriented bars which also have a simulated wood finish and similar spacing. Both the window and the door have appropriately sized, externally mounted screen panels.

Hence, it can be seen that the frames of both structures are permanently affixed to the building or home in which they are used, and the steel-to-steel interfaces for the panels render unauthorized entry virtually impossible. The panels can be opened as the need dictates during daylight hours and positively secured at night.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved door construction and mounting assembly for improved security, ventilation and aesthetics comprising, in combination:

a steel frame in a rectangular configuration having short horizontal parallel upper and lower extents and long vertical parallel interior and exterior side extents with at least one central opening extending therethrough, the interior extent having hinges for the pivotal securement to a casement and the exterior extent having a handle assembly for locking and unlocking the door;

a panel positioned within the central opening, the panel having a gridwork of horizontally disposed steel members and vertically disposed steel members in a grid-lock configuration to form rectangular apertures extending therethrough, the vertical steel members having axially aligned bores therethrough, with the spacing between the apertures sized such as to preclude the passage of a person therethrough, the panel having a plurality of inserts located within the apertures with vertical disposed hinges coupling the inserts and the vertical steel members for allowing the selective covering and uncovering of the apertures; and adjustment mechanisms for moving the inserts between closed positions and open positions, the adjustment mechanisms including a horizontally disposed rotary drive rod with exterior threads on the surface thereof located through the aligned bores, cylindrical collars with interior threads located at spaced points along the length of the drive rod at locations adjacent to the inserts, coupling links pivotally secured between the cylindrical collars and the ends of the inserts remote from the hinges and a worm gear coupled to the drive rod with a handle located on the inside of the door whereby rotation of the handle and the worm gear will rotate the drive rod to move the cylindrical collars in unison to pivot the inserts between open positions and closed positions at the discretion of an operator.

* * * * *